US005948744A

United States Patent [19]

Baillely et al.

[11] Patent Number: 5,948,744

[45] Date of Patent: Sep. 7, 1999

[54] DETERGENT COMPOSITION CONTAINING COMBINATION OF NONIONIC POLYSACCHARIDE ETHER WITH SYNTHETIC OXYALKYLENE-CONTAINING SOIL RELEASE AGENT

[76] Inventors: Gerard Marcel Baillely; Nour-Eddine Guedira; Robin Gibson Hall, all of Procter & Gamble Technical Centres Ltd, Whitley Road, Long Benton, P.O. Box Forest Hall No. 2, Newcastle upon Tyne NE12 9TS, United Kingdom

[21] Appl. No.: 08/849,576

[22] PCT Filed: Nov. 30, 1995

[86] PCT No.: PCT/US95/15547

§ 371 Date: May 29, 1997

§ 102(e) Date: May 29, 1997

[87] PCT Pub. No.: WO96/17048

PCT Pub. Date: Jun. 6, 1996

[30] Foreign Application Priority Data

Dec. 1, 1994 [GB] United Kingdom ..... 9424291

[51] Int. Cl.[6] ..... C11D 3/22; C11D 3/37

[52] U.S. Cl. ..... 510/299; 510/300; 510/470; 510/471; 510/472; 510/473; 510/474; 510/475; 510/528

[58] Field of Search ..... 510/299, 300, 510/470, 471, 472, 473, 474, 475, 528

[56] References Cited

U.S. PATENT DOCUMENTS

| | | | |
|---|---|---|---|
| 4,740,326 | 4/1988 | Hortel et al. | 510/295 |
| 4,770,666 | 9/1988 | Clauss | 8/111 |
| 4,808,086 | 2/1989 | Evans et al. | 510/517 |
| 4,877,896 | 10/1989 | Maldonado et al. | 510/299 |
| 4,976,879 | 12/1990 | Maldonado et al. | 510/299 |

*Primary Examiner*—Ardith Hertzog
*Attorney, Agent, or Firm*—Ian S. Robinson; Brian M. Bolam; Kim William Zerby

[57] ABSTRACT

Detergent compositions comprise, by weight, from 0.01% to 10% of a nonionic polysaccharide ether having a degree of polymerization of at least 100, and from 0.01% to 5% of a soil release agent. The soil release agent comprises at least one oxyalkylene unit and at least one terephthalate or substituted terephthalate unit and has a molecular weight of less than 10,000. The detergent composition comprises the polysaccharide ether and the soil release agent in a weight ratio of from 0.1:1 to 20:1.

20 Claims, No Drawings

DETERGENT COMPOSITION CONTAINING COMBINATION OF NONIONIC POLYSACCHARIDE ETHER WITH SYNTHETIC OXYALKYLENE-CONTAINING SOIL RELEASE AGENT

TECHNICAL FIELD OF THE INVENTION

The present invention relates to detergent compositions comprising soil release agents in combination with nonionic polysaccharide ethers.

BACKGROUND TO THE INVENTION

During the laundering operation of fabrics it is highly desirable to provide the fabric, particularly man-made fabrics produced from synthetic fibres, with soil release properties.

Due to the hydrophobic nature of fabrics composed of partially or completely synthetic fibres, the removal of greasy soils and stains therefrom is particularly difficult. In order to address this problem, soil release polymers may be incorporated into the detergent composition. During laundering the soil release agents are adsorbed onto the surface fabric, thereby inducing greater hydrophobicity to the fabric surface. Once the fabric is treated with a soil release agent, the ease of removal of greasy soil and stains from the surface of the fabric is considerably improved.

The main types of soil release agents incorporated into detergent compositions, which provide benefits to primarily hydrophobic synthetic fabrics include synthetic soil release agents, preferably terephthalate based and polysaccharide ethers. Polymeric soil release agents are described in the art, for example U.S. Pat. No. 4,795,584 and EPO-253 567 disclose soil release polymers comprising ethyleneoxy terephthalate and polyethyleneoxy terephthalate units having a molecular weight of 900 to 9000.

Polysaccharide ethers such as cellulose ethers have been described for example in EPO 054 325 which discloses a detergent composition having reduced soil redeposition effects comprising carboxymethyl cellulose, a linear polycarboxylate and a cellulose either having a degree of substitution (ds) of at least 0.5 and a degree of polymerisation (dp) of less than 300. GB 1 534 641 discloses nonionic surfactant detergent compositions comprising cellulose ether soil release agents such as alkyl and hydroxyalkyl cellulose ethers. U.S. Pat. No. 4,441,881 discloses detergent compositions comprising modified cellulose ethers such as alkyl and hydroxyalkyl cellulose ethers having a molecular weight of 19000 to 185000 and a degree of substitution up to 3.

The soil release performance of the polysaccharide ethers may be substantially improved upon greasy/oily stains by increasing the amount of ether used or by increasing the molecular weight or degree of polymerisation of the ether. However, such higher molecular weight polysaccharide ethers are known to have detrimental effects on the clay soil removal and anti-redeposition performance of the detergent composition in which they are incorporated. This is particularly evident on fabrics after a number of repeated washing cycles or when high dosage or concentrations of detergent composition are utilised to clean heavily soiled fabrics. This problem is also acute on fabrics which contain a high percentage of synthetic fibres.

Synthetic soil release agents, particularly those soil release agents having a significantly lower molecular weight than the polysaccharide ethers have been used to address this problem. The clay soil removal performance of the detergent composition is not as detrimentally affected by the use of synthetic soil release agents in comparison with compositions comprising polysaccharide ether. Thus, synthetic soil release agents tend to be preferred. In particular those having a low molecular weight are preferred for solubility requirements and ease of manufacture.

Thus, it is an aim of the present invention to provide a detergent composition providing increased soil removal performance without negatively affecting the particulate/clay soil removal performance.

It has now been determined that this aim can be achieved by the use of the combination of a synthetic soil release agent having a molecular weight of less than 10000 with a nonionic polysaccharide ether having an average degree of polymerisation of 100 or more.

An additional advantage of the present invention is that this combination of synthetic soil release agent and polysaccharide ether provides improved overall cleaning performance, particularly on greasy food soils, mechanical oil stains and clay.

A further advantage of the present invention is that the improved cleaning performance, especially of clay soil is achieved on a broad range of fabric types, such as synthetics for example polyester and additionally on natural/synthetic blend fabrics such as polycottons.

Synthetic soil release agents and polysaccharide ethers have been described for example in U.S. Pat. No. 4,740,326 which discloses a laundry product comprising a substrate material coated with a soil release polymer for example dryer added sheets. The soil release polymers are selected from i) alkyl or hydroxyalkyl cellulose ethers having a molar degree of substitution (ds) of from 1.5 to 2.7 and average molecular weight of from 2000 to 100000 or ii) various ethylene terephthalate and polyethylene oxide terephthalate polymers having an average molecular weight of from 1000 to 100000 and mixtures of i) and ii).

U.S. Pat. No. 4,770,666 discloses laundry detergent compositions comprising peroxyacid bleach and soil release polymers. The soil release polymers are selected from i) alkyl or hydroxyalkyl cellulose ethers having a ds of 1.5 to 2.7 and an average molar weight of 2000 to 100000 and ii) various ethylene terephthalate and polyethylene oxide terephthalate polymers having an average molecular weight of from 1000 to 100000 and mixtures of i) and ii). However, the art does not suggest the synergic effect of the combination of synthetic soil release agents with polysaccharide ethers.

SUMMARY OF THE INVENTION

The present invention relates to a detergent composition comprising the combination of a nonionic polysaccharide ether having a degree of polymerisation of 100 or more with a soil release agent comprising at least one oxyalkylene unit and having a molecular weight of less than 10000.

All weights, ratios and percentages are given as a % weight of the total composition unless otherwise stated.

DETAILED DESCRIPTION OF THE INVENTION

The present invention is a detergent composition comprising the combination of a nonionic polysaccharide ether with a soil release agent comprising at least one oxyalkylene unit.

Soil Release Agent

Thus, an essential ingredient of the present invention is a soil release agent. Any polymeric soil release agent known to those skilled in the art are employed in the compositions and processes of this invention. Polymeric soil release agents are characterised in that they impart hydrophilicity to the surface of hydrophobic fibres, such as polyester and nylon, and hydrophobic segments, to facilitate the attraction of the soil release agent to the synthetic fibres.

The soil release agents useful herein especially include those soil release agents having: (a) one or more nonionic hydrophile components consisting essentially of at least one oxyalkylene unit, preferably having a degree of polymerisation of at least 2, more preferably 2 to 10. Preferably the soil release agent further comprises at least one terephthalate or substituted terephthalate unit, preferably the soil release agent further comprises a polyester backbone comprising at least one terephthalate unit and at least one sulphoisophthalate unit and at least one end capping unit.

The following structure is illustrative, but by no means limiting, of preferred structures of ester soil release agents of the invention:

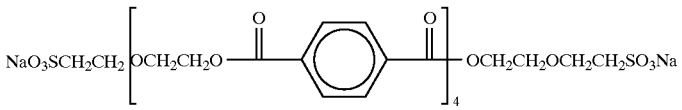

Also encompassed are certain stabilisers which reduce the crystallization problems encountered during manufacture and storage of the soil release agents as well as when introduced to the wash liquor. The stabilisers are especially useful in compositions with high ratios of oxyethyleneoxy to oxy-1,2-oxypropylene in the "backbone" structure of the agent.

The esters herein can be simply characterised as soil release agents which comprise a substantially linear ester "backbone" and end-capping units which are derived from sulfonated monohydroxy polyethoxy/propoxy monomers, especially 2-(2-hydroxyethoxy)ethanesulfonate. Proper selection of the structural units which comprise the ester backbone and use of sufficient amounts of the charged end-capping units results in the desired soil-release properties of these materials. The integration of stabilisers into the agent reduces the crystallization of the agent during manufacture and when introduced into the wash liquor, thereby enhancing the dissolution/dispersion and the soil release performance.

Oligomeric Esters—It is to be understood that the compositions herein are not resinous, high molecular weight, macromolecular or fibre-forming polyesters but, instead are relatively low molecular weight and contain species more appropriately described as oligomers rather than as polymers. Individual ester molecules herein, including the end-capping units, can have molecular weights ranging from 500 to about 8,000. Relevant for purposes of comparison with glycolterephthalate fibrous polyesters (typically averaging 15,000 or more in molecular weight) is the molecular weight range from about 500 to about 5,000, within which molecules of the preferred esters of the invention which incorporate the essential units and 5-sulfoisophthalate are generally found.

Molecular Geometry—The soil release agents employed herein are all "substantially linear" in the sense that they are not significantly branched or crosslinked by virtue of the incorporation into their structure of units having more than two ester-bond forming sites. A typical example of polyester branching or crosslinking of this type is exemplified in Sinker et al, U.S. Pat. No. 4,554,328, issued Nov. 19, 1985.) Furthermore, no cyclic esters are essential for the purposes of the invention but may be present in the compositions of the invention at low levels as a result of side-reactions during ester synthesis. Preferably, cyclic esters will not exceed about 2% by weight of the compositions; most preferably, they will be entirely absent from the compositions.

Contrasting with the above, the term "substantially linear" as applied to the esters herein does, however, expressly encompass materials which contain side-chains which are unreactive in ester-forming or transesterification reactions. Thus, oxy-1,2-propyleneoxy units are of an unsymmetrically substituted type; their methyl groups do not constitute what is conventionally regarded as "branching" in polymer technology (see Odian, Principles of Polymerisation, Wiley, N.Y., 1981, pages 18–19, with which the present definitions are fully consistent) and are unreactive in ester-forming reactions. Optional units in the esters of the invention can likewise have side-chains, provided that they conform with the same nonreactivity criterion.

Molecular Structures—The following structures are illustrative of structures of ester molecules falling within the foregoing preferred embodiments, and demonstrate how the units are connected;

a) doubly end-capped ester unit;

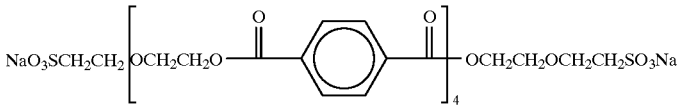

b) singly end-capped ester units;

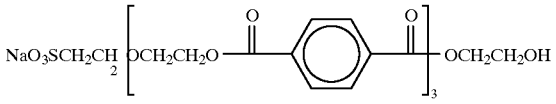

c) doubly end-capped ester unit(termed a "hybrid backbone" ester molecule herein) may be comprised of a mixture of oxyethyleneoxy and oxy-1,2-propyleneoxy units, in the example shown below at a 2:1 mole ratio (on average, in ester compositions as a whole in contrast to individual molecules such as illustrated here, ratios ranging from about 1:1 to about 10:1 are the most highly preferred.

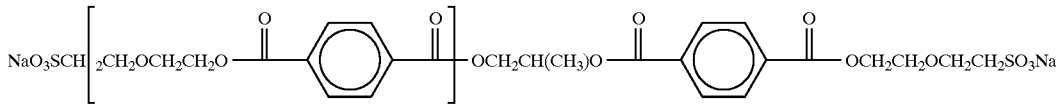

d) doubly end-capped ester units. On average, in ester compositions as a whole in contrast to individual molecules such as illustrated below, the most highly preferred ratios of oxyethyleneoxy to oxy-1,2-propyleneoxy units range from about 0.5:1 to 1:0.

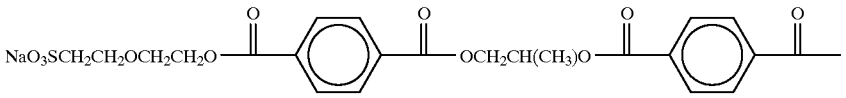

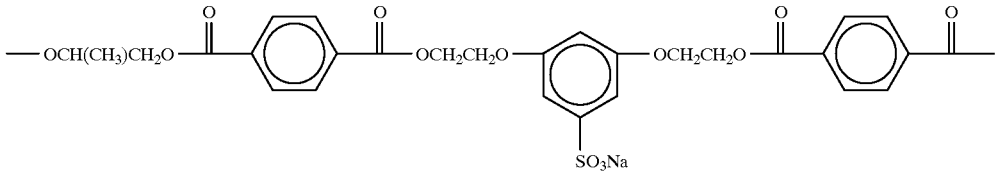

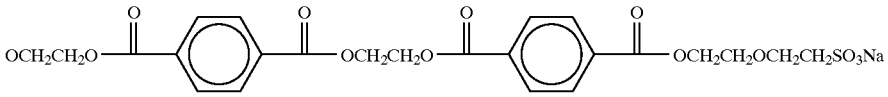

In addition the molecular structures of the ester molecules may also include singly or doubly-endcapped ester molecules having alkyl branching or having polyethyleneglycol extensions.

In the context of the structures of ester molecules disclosed herein it should be recognised that the present invention encompasses not only the arrangement of units at the molecular level but also the gross mixtures of esters which result from the reaction schemes herein and which have the desired range of composition and properties. Accordingly, when the number of monomer units or ratios of units are given, the numbers refer to an average quantity of monomer units present in oligomers of the composition.

Ester Backbone—A illustrated in the structures shown above, in the esters of this invention, the backbone is formed by oxyethyleneoxy and terephthaloyl units connected in alternation. Optionally, the backbone is formed by 5-sulfoisophthaloyl units, terephthaloyl units, oxyethyleneoxy or mixtures of oxyethyleneoxy, oxypropyleneoxy and poly(oxyethyleneoxy) units connected with alternation of the aryldicarbonyl and oxyalkyleneoxy units.

Groups at the Termini of the Ester Backbone—Likewise, the "polyester backbone of the invention" is a term which encompasses doubly and singly end-capped compounds disclosed herein, mixtures thereof, and mixtures of said end-capped materials which may unavoidably contain some non-capped species. Although, levels of the latter will be zero or at a minimum in all of the highly preferred compositions. Thus, when referred to herein, it is intended to refer, by definition, collectively to the mixture of capped and uncapped ester molecules resulting from any single preparation.

Any soil release molecules which are present in compositions of the invention which are not fully, i.e., doubly, end-capped by the end-capping units must terminate with units which are not sulfonated polyethoxy/propoxy end-capping units. These termini will typically be hydroxyl groups or other groups attributable to the unit-forming reactant. In other structures which may be constructed, units such as —(O)$CC_6H_4C$(O)—$OCH_3$ may be found in terminal positions. All the most highly preferred ester molecules herein will, however, as indicated above, have two sulfonated end-capping units and no backbone units occupying terminal positions.

Symmetry—It is to be appreciated that in esters in which oxy-1,2-propyleneoxy units are also present, the oxy-1,2-propyleneoxy units can have the methyl groups randomly alternating with one of the adjacent —$CH_2$-hydrogen atoms, thereby lowering the symmetry of the ester chain. Thus, the oxy-1,2-propyleneoxy unit can be depicted as having either the —$OCH_2CH(CH_3)O$— orientation or as having the opposite —$OCH(CH_3)CH_2O$— orientation. Carbon atoms in the oxy-1,2-propylene units to which the methyl groups are attached are, furthermore, asymmetric, i.e., chiral; they have four non-equivalent chemical entities attached.

In contrast to the oxy-1,2-propyleneoxy units, oxyethyleneoxy units cannot be used herein as a sole source of oxy-1,2-alkyleneoxy units without the addition of stabilisers since they lack the needed unsymmetrical character. It is the presence of the unsymmetrical units and/or of the stabilisers that inhibit the crystallization of the oligomer during manufacture and later when added to the wash liquor. The use of oxyethyleneoxy units or high ratios of oxyethyleneoxy to oxypropyleneoxy units, therefore, must be accompanied by the use of stabilisers to retard the formation of crystals. Accordingly, such compositions herein contain sulfonate-type hydrotropes, linear or branched alkylbenzenesulfonates, paraffin sulfonates, and mixtures thereof integrated into the oligomer composition.

Preferably, various optional units of a hydrophilicity enhancing and nonpolyester substantive type can be incorporated into the esters. The pattern of such incorporation will generally be random. Preferred optional units are anionic hydrophiles, such as 5-sulfoisophthaloyl or similar units. Such units will, when incorporated into the ester backbone, generally divide it into two or more hydrophobic moieties separated by one or more hydrophilic moieties.

It should also be noted that the essential non-charged aryldicarbonyl units herein need not exclusively be terephthaloyl units, provided that the polyester fabric-substantivity of the ester is not harmed to a significant extent. Thus, for example, minor amounts of isomeric non-charged dicarbonyl units, such as isophthaloyl or the like, are acceptable for incorporation into the esters.

Poly(oxyethylene)oxy units—The optional poly(oxyethylene)oxy units comprising the esters of the present invention have a degree of polymerization of from 2 to 4 and can constitute from 0 to about 25 mole percent of the total oxyalkyleneoxy units present. Preferably, poly(oxyethylene)oxy units are present when the backbone unit comprises 8 or more terephthaloyl units; however, at least some poly(oxyethylene)oxy units are present in esters with as few an average 1.5 terephthaloyl units. The poly(oxyethylene)oxy units, especially in esters with 8 or more terephthaloyl units, aid in the rate of dissolution of the soil release agent into the wash liquor.

The amount of poly(oxyethylene)oxy units present in the backbone is related to its degree of polymerisation. For example, oxyethyleneoxyethyleneoxy units (formed from diethylene glycol), which have a degree of polymerisation of two, can constitute from 0 to 25 mole percent of the total oxyalkyleneoxy units in the backbone. Oxyethyleneoxyethyleneoxyethyleneoxyethyleneoxy units (formed from tetraethylene glycol), which have a degree of polymerisation of four, can constitute from 0 to 12 mole percent of the total oxyalkyleneoxy units present in the backbone.

Capping units—According to the present invention at least 50%, of said soil release agent comprises at least one terminal capping unit selected from anionic, nonionic, cationic capping units and mixtures thereof.

Suitable anoinic capping unit for use herein are according to the formula $(MO_3S)(CH_2)_m(CH_2CH_2O)(RO)_n$, wherein M is a salt forming cation such as sodium or tetraalkylammonium, m is 0 or 1, R is ethylene, propylene or a mixture thereof and n is from 0 to 2. Preferably said end capping unit is derived from sulphobenzoic acid or derivatives thereof. These end-cap units provide anoinic charged sites when the esters are dispersed in aqueous media, such as a laundry liquor. It is not intended to exclude the acid form, but most generally the esters herein are used as sodium salts, as salts of other alkali metals as salts with nitrogen-containing cations (especially tetraalkylammonium), or as the disassociated ions in a aqueous environment.

Examples of end-capping groups include sodium isethionate, sodium 2-(2-hydroxyethoxy) ethanesulfonate, sodium 2-[2-(2-hydroxyethoxy)ethoxy] ethanesulfonate, sodium 5-hydroxy-4-methyl-3-oxa-pentanesulfonate, sodium alpha-3-sulfopropyl-omega-hydroxypoly-(oxy-1,2-ethanediyl)(with average degree of ethoxylation of 1–2), sodium 5-hydroxy-3-oxa-hexanesulfonate, and mixtures thereof.

On a mole basis, the compositions herein will preferably comprise from about one to about two moles of the sulfonated end-capping units per mole of the ester. Most preferably, the esters are doubly end-capped; i.e., there will be two moles of end-capping units present per mole of the ester. From the viewpoint of weight composition, it will be clear that the fractional contribution of end-capping units to the molecular weight of the esters will decrease as the molecular weight of the ester backbone increases.

Suitable nonionic endcapping units are consecutive polyethylene glycol units, preferably from 2 to 20 consecutive polyethylene glycol units.

Suitable cationic end capping units are quaternary ammonium or quaternary ammonium salts according to the formula $R_4N^+$, wherein each R is independently selected from $C_1$–$C_4$ alkyl groups, $C_1$–$C_4$ hydroxyalkyl groups, $C_2$–$C_4$ alkylene groups, $C_2$–$C_4$ oxyalkylene groups, phenyl, phenyl $C_1$–$C_4$ alkyl groups, hydrogen and wherein two R groups can be joined to form cyclic structures. Suitable cationic end capped soil release polymers for use herein are described in EPO-398 133.

Stabilisers—Stabilisers useful in this invention should be water soluble or water dispersible. The stabilising agents that are useful herein include sulfonate-type hydrotropes, linear or branched alkylbenzenesulfonates, paraffin sulfonates, and other thermally-stable alkyl sulfonate variations with from about 4 to about 20 carbon atoms. Preferred agents include sodium dodecylbenzenesulfonate, sodium cumenesulfonate, sodium toluenesulfonate, sodium xylenesulfonate, and mixtures thereof. When higher levels of stabilisers are used, mixtures of hydrotropes and/or other stabilisers are preferred over pure components to insure full integration into the oligomer and to reduce the possibility of crystallization of the stabiliser.

In general, the level of such agents should be kept as low as possible while providing the primary benefit, i.e., the reduction in the amount of crystallization that the soil release agent undergoes during manufacture, storage and when introduced to the wash liquor. The composition may comprise from about 0.5% to about 20% stabiliser. Most preferably, these ester compositions comprise an amount sufficient to reduce the crystallization of the oligomer during manufacture and when introduced to the wash liquor, i.e., at least 3% by weight.

The stabilisers may be added to the soil release agent in various ways. Preferably, the stabilisers are added to the oligomer reagents in the initial stages prior to full oligomerization. The stabilisers thereby integrate uniformly into the oligomer. Another method would entail first melting the pre-formed oligomer and then uniformly mixing the stabiliser into the molten oligomer.

Alkylbenzenesulfonates when used as surfactants in detergent compositions do not provide the stabilising and crystallization reducing effect, even during dissolution of the soil release agent in the laundry liquor, that the stabiliser does when it is added as directed above.

A preferred polymeric soil release agent is a polyester with repeat units of ethylene terephthalate units contains 10–15% by weight of ethylene terephthalate units together with 90-80% by weight of polyoxyethylene terephthalate units, derived from a polyoxyethylene glycol of average molecular weight 300–5,000. Examples of this polymer include the commercially available material ZELCON 5126 (from Dupont) and MILEASE T (from ICI). See also U.S. Pat. No. 4,702,857, issued Oct. 27, 1987 to Gosselink.

Another preferred polymeric soil release agent is a sulfonated product of a substantially linear ester oligomer comprised of an oligomeric ester backbone of terephthaloyl and oxyalkyleneoxy repeat units and terminal moieties covalently attached to the backbone. These soil release agents are described fully in U.S. Pat. No. 4,968,451, issued Nov. 6, 1990 to J. J. Scheibel and E. P. Gosselink. Other suitable polymeric soil release agents include the terephthalate polyesters of U.S. Pat. No. 4,711,730, issued Dec. 8, 1987 to Gosselink et al, the anionic end-capped oligomeric esters of U.S. Pat. No. 4,721,580, issued Jan. 26, 1988 to Gosselink, and the block polyester oligomeric compounds of U.S. Pat. No. 4,702,857, issued Oct. 27, 1987 to Gosselink. Preferred polymeric soil release agents also include the soil release agents of U.S. Pat. No. 4,877,896, issued Oct. 31, 1989 to Maldonado et al, which discloses anionic, especially sulfoarolyl, end-capped terephthalate esters.

According to the present invention the soil release agent has a molecular weight of less than 10000, preferably less than 5000. According to the present invention the detergent compositions comprise from 0.01% to 5%, typically from 0.01% to 3%, preferably from 0.01% to 1.0%

Methods of Making Soil Release Agents

The soil release agents of the present invention can be prepared using any one of combination of several alternative general reaction types, each being well known in the art. Types of synthetic and analytical methods useful herein are illustrated in EPO 185 427 and in "Principles of polymerisation", Odien, Wiley, N.Y., 1981. The general types of reactions suitable for preparing the soil release agents of the present invention include those classifiable as:

1. alcoholysis of acyl halides
2. esterification of organic acids
3. alcoholysis of esters(transesterification) and
4. reaction of alkylene carbonates with organic acids.

Reaction types 2–4, preferably 3–4 are preferred.

Polysaccharide Ethers

According to the present invention an essential component of the detergent composition is a nonionic polysaccharide ether. Chemically, the polysaccharides are composed of pentoses or hexoses. Suitable polysaccharide ethers for use herein are selected from cellulose ethers, starch ethers, dextran ethers and mixtures thereof. Preferably said nonionic polysaccharide ether is a cellulose ether. Cellulose ethers are generally obtained from vegetable tissues and fibres, including cotton and wood pulp.

The hydroxy group of the anhydro glucose unit of cellulose can be reacted with various reagents thereby replacing the hydrogen of the hydroxyl group with other chemical groups. Various alkylating and hydroxyalkylating agents can be reacted with cellulose ethers to produce either alkyl-, hydroxyalkyl- or alkylhydroxyalkyl-cellulose ethers or mixtures thereof. The most preferred for use in the present invention are $C_1$–$C_4$alkyl cellulose ether or a $C_1$–$C_4$ hydroxyalkyl cellulose ether or a $C_1$–$C_4$ alkylhydroxy alkyl cellulose ether or mixtures thereof. Preferably the polysaccharides of the present invention have a degree of substitution of up to 3, preferably from 0.5 to 2.5, most preferably from 0.5 to 2.2 inclusive.

Suitable cellulose ethers include methylcellulose ether, hydroxypropyl methylcellulose ether, hydroxyethyl methylcellulose ether, hydroxypropyl cellulose ether, hydroxybutyl methylcellulose ether, ethylhydroxy ethylcellulose ether, ethylcellulose ether and hydroxy ethylcellulose ether. Most preferably said polysaccharide is a methylcellulose ether. Such agents are commercially available such as METHOCEL (Dow Chemicals).

According to the present invention said polysaccharide ether has a degree of polymerisation of more than 100, preferably from 100 to 10000. As used herein the term degree of polymerisation (dp) is the ratio of the weight average molecular weight on average molecular unit weight, i.e. $dp=MW_w/MUW$. The weight average molecular weight ($MW_w$) is obtained by standard analytical methods as described in Polymer handbooks. A preferred method is light scattering from polymer solutions as originally defined by Debye.

For example the average molecular unit weight (MUW) for methylcellulose ether may be determined from the sum of the molecular weight of the unsubstituted cellulose unit and the product of the degree of polymerisation and the molecular weight of the substituent less the hydrogen mass (1).

i.e. MUW=162+(15−1)* ds—for methyl substituents found in methyl cellulose ethers.

MUW may also be determined from the "% methoxyl content" value (mc) also used by manufactures of methyl cellulose ethers instead of the degree of substitution, such that;

$$MUW=100-[(\text{mol. wt. of } CH_2/\text{mol. wt. of } OCH_3)*mc]$$

The compositions of the present invention comprise from 0.01% to 10%, preferably from 0.01% to 3% of said nonionic polysaccharide ethers. According to the present invention the detergent compositions comprise said polysaccharide and soil release polymer in a ratio of from 0.1:1 to 20:1, preferably from 0.5:1 to 10:1.

According to the present invention the detergent compositions may comprise additional ingredients such as surfactants, other anti-redeposition agents, builders, chelants, bleaches and the like.

Clay Soil Removal/Anti-redeposition Agents

The compositions of the present invention can also optionally contain clay soil removal and antiredeposition agents. Granular detergent compositions which contain these compounds typically contain from 0.01% to 10.0% by weight of said agents, liquid detergent compositions typically contain 0.01% to 5%. Suitable clay soil removal and/or anti redeposition agents known in the art includes the carboxy methyl cellulose (CMC) materials.

Detersive Surfactants

According to the present invention the detergent composition may preferably comprise surfactants. Surfactants useful herein include the conventional $C_{11}$–$C_{18}$ alkyl benzene sulphonates ("LAS") and primary, branched-chain and random $C_{10}$–$C_{20}$ alkyl sulphates ("AS"), the $C_{10}$–$C_{18}$ secondary (2,3) alkyl sulphates of the formula $CH_3(CH_2)_x(CHOSO_3^-M^+)$ $CH_3$and $CH_3$ $(CH_2)_y(CHOSO_3^-M^+)$ $CH_2CH_3$ where x and (y+1) are integers of at least about 7, preferably at least about 9, and M is a water-solubilizing cation, especially sodium, unsaturated sulphates such as oleyl sulphate, the $C_{10}$–$C_{18}$ alkyl alkoxy sulphates ("$AE_xS$"; especially EO 1–7 ethoxy sulphates), $C_{10}$–$C_{18}$ alkyl alkoxy carboxylates (especially the EO 1–5 ethoxycarboxylates), the $C_{10-18}$ glycerol ethers, the $C_{10}$–$C_{18}$ alkyl polyglycosides and their corresponding sulphated polyglycosides, and $C_{12}$–$C_{18}$ alpha-sulphonated fatty acid esters.

If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulphobetaines ("sultaines"), $C_{10}$–$C_{18}$ amine oxides, and the like, can also be included in the overall compositions. The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-(3-methoxypropyl) glucamide. The N-proply through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Mixtures of anionic and nonionic surfactants are especially useful. Other conventional useful surfactants such as cationics are listed in standard texts.

According to the present invention the compositions comprise from 1% to 80%, preferably from 5% to 50%, most preferably from 10% to 40% of a surfactant. Preferred surfactants for use herein are linear alkyl benzene sulphonate, alkyl sulphates and alkyl alkoxylated nonionics or mixtures thereof.

Builders

Detergent builders can optionally be included in the compositions herein to assist in controlling mineral hardness. Inorganic as well as organic builders can be used. Builders are typically used in fabric laundering compositions to assist in the removal of particulate soils.

The level of builder can vary widely depending upon the end use of the composition and its desired physical form. When present, the compositions will typically comprise at least 1% builder. Liquid formulations typically comprise from 5% to 50%, more typically about 5% to 30%, by weight, of detergent builder. Granular formulations typically comprise from 10% to 80%, more typically from 15% to 50% by weight, of the detergent builder. Lower or higher levels of builder, however, are not meant to be excluded.

Inorganic or P-containing detergent builders include, but are not limited to, the alkali metal, ammonium and alkanolammonium salts of polyphosphates (exemplified by the tripolyphosphates, pyrophosphates, orthophosphates and glassy polymeric meta-phosphates). phosphonates, phytic acid, silicates, carbonates (including bicarbonates and sesquicarbonates), sulphates, and aluminosilicates (see, for example, U.S. Pat. Nos. 3,159,581; 3,213,030; 3,422,021; 3,400,148 and 3,422,137)

However, non-phosphate builders are required in some locales. Importantly, the compositions herein function surprisingly well even in the presence of the so-called "weak" builders (as compared with phosphates) such as citrate, or in the so-called "underbuilt" situation that may occur with zeolite or layered silicate builders.

Examples of silicate builders are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839, issued May 12, 1987 to H. P. Rieck. NaSKS-6 is the trademark for a crystalline layered silicate marketed by Hoechst (commonly abbreviated herein as "SKS-6"). Unlike zeolite builders, the Na SKS-6 silicate builder does not contain aluminum. NaSKS-6 has the delta-$Na_2Si_2O_5$ morphology form of layered silicate. It can be prepared by methods such as those described in German DE-A-3,417,649 and DE-A-3,742,043. SKS-6 is a highly preferred layered silicate for use herein, but other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-11, as the alpha, beta and gamma forms. As noted above, the delta-$Na_2Si_2O_5$ (NaSKS-6 form) is most preferred for use herein. Other silicates may also be useful such as for example magnesium silicate, which can serve as a crispening agent in granular formulations, as a stabilizing agent for oxygen bleaches, and as a component of suds control systems.

Examples of carbonate builders are the alkaline earth and alkali metal carbonates as disclosed in German Patent Application No. 2,321,001 published on Nov. 15, 1973.

Aluminosilicate builders are useful in the present invention. Aluminosilicate builders are of great importance in most currently marketed heavy duty granular detergent compositions, and can also be a significant builder ingredient in liquid detergent formulations. Aluminosilicate builders include those having the empirical formula:

$$M_z[(SiO_2)_w(zAlO_2)_y].xH_2O$$

wherein w, z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al, issued Oct. 12, 1976. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula:

$$Na_{12}[(AlO_2)_{12}(SiO_2)_{12}].xH_2O$$

wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt. When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in Berg, U.S. Pat. No. 3,128,287, issued Apr. 7, 1964, and Lamberti et al, U.S. Pat. No. 3,635,830, issued Jan. 18, 1972. See also "TMS/TDS" builders of U.S. Pat. No. 4,663,071, issued to Bush et al, on May 5, 1987. Suitable ether polycarboxylates also include cyclic compounds, particularly alicyclic compounds, such as those described in U.S. Pat. Nos. 3,923,679; 3,835,163; 4,158,635; 4,120,874 and 4,102,903.

Other useful detergency builders include the ether hydroxypolycarboxylates, copolymers of maleic anhydride with ethylene or vinyl methyl ether, 1, 3, 5-trihydroxy benzene-2, 4, 6-trisulphonic acid, and carboxymethyloxysuccinic acid, the various alkali metal, ammonium and substituted ammonium salts of polyacetic acids such as ethylenediamine tetraacetic acid and nitrilotriacetic acid as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance for heavy duty liquid detergent formulations due to their availability from renewable resources and their biodegradability. Citrates can also be used in granular compositions, especially in combination with zeolite and/or layered silicate builders. Oxydiscussinates are also especially useful in such compositions and combinations.

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Other suitable polycarboxylates are disclosed in U.S. Pat. No. 4,144,226, Crutchfield et al, issued Mar. 13, 1979 and in U.S. Pat. No. 3,308,067, Diehl, issued Mar. 7, 1967. See also Diehl U.S. Pat. No. 3,723,322.

Fatty acids, e.g., $C_{12}$–$C_{18}$ monocarboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

Chelating Agents

The detergent compositions herein may also optionally contain one or more iron and/or manganese chelating agents. Such chelating agents can be selected from the group consisting of amino carboxylates, amino phosphonates, polyfunctionally-substituted aromatic chelating agents and mixtures therein, all as hereinafter defined. Without intending to be bound by theory, it is believed that the benefit of these materials is due in part to their exceptional ability to remove iron and manganese ions from washing solutions by formation of soluble chelates.

Amino carboxylates useful as optional chelating agents include ethylenediaminetetracetates, N-hydroxyethylethylenediaminetriacetates, nitrilotriacetates, ethylenediamine tetraproprionates, triethylenetetra-aminehexacetates, diethylenetriaminepentaacetates, and ethanoldiglycines, alkali metal, ammonium, and substituted ammonium salts therein and mixture therein.

Amino phosphonates are also suitable for use as chelating agents in the compositions of the invention when at least low levels of total phosphorus are permitted in detergent compositions, and include ethylenediaminetetrakis (methylenephosphonates) as DEQUEST. Preferred, these amino phosphonates to not contain alkyl or alkenyl groups with more than about 6 carbon atoms.

Polyfunctionally-substituted aromatic chelating agents are also useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelator for use herein is ethylenediamine disuccinate ("EDDS"), especially the [S,S] isomer as described in U.S. Pat. No. 4,704,233, Nov. 3, 1987, to Hartman and Perkins.

If utilized, these chelating agents will generally comprise from 0.1% to 10% more preferably, from 0.1% to 3.0% by weight of such compositions.

Bleaching Compounds—Bleaching Agents and Bleach Activators

The detergent compositions herein may optionally contain bleaching agents or bleaching compositions containing a bleach agent and one or more bleach activators. When present, bleaching agent will typically be at levels of from 1% to 40%, more typically from 5% to 30%, of the detergent composition, especially for fabric laundering. If present, the amount of bleach activators will typically be from 0.1% to 60%, more typically from 0.5% to 40% of the bleaching composition comprising the bleaching agent-plus-bleach activator.

The bleaching agents used herein can be any of the bleaching agents useful for detergent compositions in textile cleaning, hard surface cleaning, or other cleaning purposes that are now known or become known. These include oxygen bleaches as well as other bleaching agents.

Peroxygen bleaching agents can also be used. Suitable peroxygen bleaching compounds include sodium carbonate peroxyhydrate and equivalent "percarbonate" bleaches, sodium pyrophosphate peroxyhydrate, urea peroxyhydrate, and sodium peroxide. Persulfate bleach (e.g., OXONE, manufactured commercially by DuPont) can also be used.

A preferred percarbonate bleach comprises dry particles having an average particle size in the range from about 500 micrometers to about 1,000 micrometers, not more than about 10% by weight of said particles being smaller than about 200 micrometers and not more than about 10% by weight of said particles being larger than about 1,250 micrometers. Optionally, the percarbonate can be coated with silicate, borate or water-soluble surfactants. Preferred coatings are based on carbonate/sulphate mixtures. Percarbonate is available from various commercial sources such as FMC, Solvay and Tokai Denka.

Another category of bleaching agent that can be used without restriction encompasses percarboxylic acid bleaching agents and salts thereof. Suitable examples of this class of agents include magnesium monoperoxyphthalate hexahydrate, the magnesium salt of metachloro perbenzio acid, 4-nonylamino-4-oxoperoxybutyric acid and diperoxydodecanedioic acid. Such bleaching agents are disclosed in U.S. Pat. No. 4,483,781, Hartman, issued Nov. 20, 1984, U.S. patent application Ser. No. 740,446, Burns et al, filed Jun. 3, 1985, European Patent Application 0,133,354, Banks et al, published Feb. 20, 1985, and U.S. Pat. No. 4,412,934, Chung et al, issued Nov. 1, 1983. Highly preferred bleaching agents also include 6-nonylamino-6-oxoperoxycaproic acid as described in U.S. Pat. No. 4,634,551, issued Jan. 6, 1987 to Burns et al.

Mixtures of bleaching agents can also be used. Peroxygen bleaching agents, the perborates, e.g., sodium perborate (e.g., mono- or tetra-hydrate), the percarbonates, etc., are preferably combined with bleach activators, which lead to the in situ production in aqueous solution (i.e., during the washing process) of the peroxy acid corresponding to the bleach activator. Various nonlimiting examples of activators are disclosed in U.S. Pat. No. 4,915,854, issued Apr. 10, 1990 to Mao et al, and U.S. Pat. No. 4,412,934. The nonanoyloxybenzene sulfonate (NOBS) and tetraacetyl ethylene diamine (TAED) activators are typical, and mixtures thereof can also be used. See also U.S. Pat. No. 4,634,551 for other typical bleaches and activators useful herein.

Highly preferred amido-derived bleach activators are those of the formulae:

$$R^1N(R^5)C(O)R^2C(O)L \text{ or } R^1C(O)N(R^5)R^2C(O)L$$

wherein $R^1$ is an alkyl group containing from about 6 to about 12 carbon atoms, $R^2$ is an alkylene containing from 1 to about 6 carbon atoms, $R^5$ is H or alkyl, aryl, or alkaryl containing from about 1 to about 10 carbon atoms, and L is any suitable leaving group. A leaving group is any group that is displaced from the bleach activator as a consequence of the nucleophilic attach on the bleach activator by the perhydroxyl anoin. A preferred leaving group is phenol sulfonate.

Preferred examples of bleach activators of the above formulae include (6-octanamido-caproyl) oxybenzenesulfonate, (6-nonanamidocaproyl)-oxybenzenesulfonate, (6-decanamidocaproyl) oxybenzenesulfonate, and mixtures thereof as described in U.S. Pat. No. 4,634,551, incorporated herein by reference.

Another class of bleach activators comprises the benzoxazin-type activators disclosed by Hodge et al in U.S. Pat. No. 4,966,723, issued Oct. 30, 1990, incorporated herein by reference. A highly preferred activator of the benzoxazin-type is:

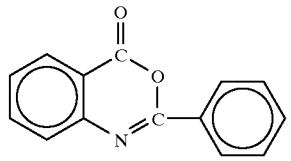

Still another class of preferred bleach activators includes the acyl lactam activators, especially acyl caprolactams and acyl valerolactams of the formulae:

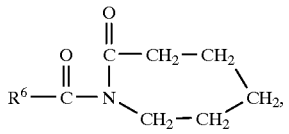

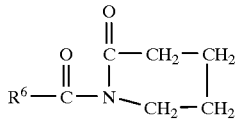

wherein $R^6$ is H or an alkyl, aryl alkoxyaryl, or alkaryl group containing from 1 to about 12 carbon atoms. Highly preferred lactam activators include benzoyl caprolactam, octanoyl caprolactam, 3,5,5-trimethylhexanoyl caprolactam, nonanoyl caprolactam, decanoyl caprolactam, undecenoyl caprolactam, benzoyl valerolactam, octanoyl valerolactam, decanoyl valerolactam, undecenoyl valerolactam, nonanoyl valerolactam, 3,5,5-trimethylhexanoyl valerolactam and mixtures thereof. See also U.S. Pat. No. 4,545,784, issued to Sanderson, Oct. 8, 1985, incorporated herein by reference, which discloses acyl caprolactams, adsorbed into sodium perborate. Other preferred activators are cationic bleach activators.

Bleaching agents other than oxygen bleaching agents are also known in the art and can be utilized herein. One type of non-oxygen bleaching agent of particular interest includes photoactivated bleaching agents such as the sulfonated zinc and/or aluminum phthalocyanines. See U.S. Pat. No. 4,033,718, issued Jul. 5, 1977 to Holcombe et al. If used, detergent compositions will typically contain from 0.025% to 1.25%, by weight, of such bleaches, especially sulfonate zinc phthalocyanine.

If desired, the bleaching compounds can be catalyzed by means of a manganese compound. Such compounds are well known in the art and include, for example, the manganese-based catalysts disclosed in U.S. Pat. No. 5,246,621, U.S. Pat. No. 5,244,594; U.S. Pat. No. 5,194,416; U.S. Pat. No. 5,114,606; and European Pat. App. Pub. Nos. 549,271A1, 549,272A1, 544,440A2,and 544,490A1; Preferred examples of these catalysts include $Mn^{IV}_2(u—O)_3$(1,4,7-trimethyl-1,4,7-triazacyclononane)$_2(PF_6)_2$, $Mn^{III}_2(u—O)_1(u—OAc)_2$(1,4,7-trimethyl-1,4,7-triazacyclononane)$_2$-$(ClO_4)_2$, $Mn^{IV}_4(u—O)_6$(1,4,7-triazacyclononane)$_4(ClO_4)_4$, $Mn^{III}Mn^{IV}_4(u—O)_1(u—OAc)_2$-(1,4,7-trimethyl-1,4,7-triazacyclononane)$_2(ClO_4)_3$, $Mn^{IV}$(1,4,7-trimethyl-1,4,7-triazacyclononane)-$(OCH_3)_3(PF_6)$, and mixtures thereof. Other metal-based bleach catalysts include those disclosed in U.S. Pat. No. 4,430,243 and U.S. Pat. No. 5,114,611. The use of manganese with various complex ligands to enhance bleaching is also reported in the following U.S. Pat. Nos.: 4,728,455; 5,284,944; 5,246,612; 5,256,779; 5,280,117; 5,274,147; 5,153,161; 5,227,084.

Polymeric Dispersing Agents

Polymeric dispersing agents can advantageously be utilized at levels from 0.1% to 7%, by weight, in the compositions herein, especially in the presence of zeolite and/or layered silicate builders. Suitable polymeric dispersing agents include polymeric polycarboxylates and polyethylene glycols, although others known in the art can also be used. It is believed, though it is not intended to be limited by theory, that polymeric dispersing agents enhance overall detergent builder performance, when used in combination with other builders (including lower molecular weight polycarboxylates) by crystal growth inhibition, particular soil release peptization, and anti-redeposition.

Polymeric polycarboxylate materials can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence in the polymeric polycarboxylates herein or monomeric segments, containing no carboxylate radicals such as vinylmethyl ether, styrene, ethylene, etc. is suitable provided that such segments do not constitute more than about 40% by weight.

Particularly suitable polymeric polycarboxylates can be derived from acrylic acid. Such acrylic acid-based polymers which are useful herein are the water-soluble salts of polymerized acrylic acid. The average molecular weight of such polymers in the acid form preferably ranges from about 2,000 to 10,000, more preferably from about 4,000 to 7,000 and most preferably from about 4,000 to 5,000. Water-soluble salts of such acrylic acid polymers can include, for example, the alkali metal, ammonium and substituted ammonium salts. Soluble polymers of this type are known materials. Use of polyacrylates of this type in detergent compositions has been disclosed, for example, in Diehl, U.S. Pat. No. 3,308,067, issued Mar. 7, 1967.

Acrylic/maleic-based copolymers may also be used as a preferred component of the dispersing/anti-redeposition agent. Such materials include the water-soluble salts of copolymers of acrylic acid and maleic acid. The average molecular weight of such copolymers in the acid form preferably ranges from about 2,000 to 100,000, more preferably from about 5,000 to 75,000, most preferably from about 7,000 to 65,000. The ratio of acrylate to maleate segments in such copolymers will generally range from about 30:1 to about 1:1, more preferably from about 70:30 to 30:70. Water-soluble salts of such acrylic acid/maleic acid copolymers can include, for example, the alkali metal, ammonium and substituted ammonium salts. Soluble acrylate/maleate copolymers of this type are known materials which are described in European Patent Application No. 66915, published Dec. 15, 1982, as well as in Ep 193,360, published Sep. 3, 1986, which also describes such polymers comprising hydroxypropylacrylate. Still other useful dispersing agents include the maleic/acrylic/vinyl alcohol or acetate terpolymers. Such materials are also disclosed in EP 193,360, including, for example, the 45/45/10 terpolymer of acrylic/maleic/vinyl alcohol.

Another polymeric material which can be included is polyethylene glycol (PEG). PEG can exhibit dispersing agent performance as well as act as a clay soil removal-antiredeposition agent. Typical molecular weight ranges for these purposes range from about 500 to about 10,000, preferably from about 1,000 to about 50,000, more preferably from about 1,500 to about 10,000.

Polyamino acid dispersing agents such as polyasparate and polyglutamatemay also be used, especially in conjunction with zeolite builders. Dispersing agents such as polyaspartate preferably have a molecular weight (avg.) of about 10,000.

Dye Transfer Inhibiting Agents

The compositions of the present invention may also include one or more materials effective for inhibiting the transfer of dyes from one fabric to another during the cleaning process. Generally, such dye transfer inhibiting agents include polyvinyl pyrrolidone polymers, polyamine N-oxide polymers, copolymers of N-vinylpyrrolidone and N-vinylimidazole, manganese phthalocyanine, peroxidases, and mixtures thereof. If used, these agents typically comprise from 0.01% to 10% by weight of the composition, preferably from 0.01% to 5%, and more preferably from 0.05% to 2%.

More specifically, the polyamine N-oxide polymers preferred for use herein contain units having the following structural formula: $R—A_x—P$; wherein P is a polymerizable unit to which an N—O group can be attached or the N—O group can form part of the polymerizable unit or the N—O group can be attached to both units; A is one of the following structures: —NC(O)—, —C(O)O—, —S—, —O—, —N═; x is 0 or 1; and R is aliphatic, ethoxylated aliphatics, aromatics, heterocyclic or alicyclic groups or any combination thereof to which the nitrogen of the N—O group can be attached or the N—O group is part of these groups. Preferred polyamine N-oxides are those wherein R is a heterocyclic group such as pyridine, pyrrole, imidazole, pyrrolidine, piperidine and derivatives thereof.

The N—O group can be represented by the following general structures:

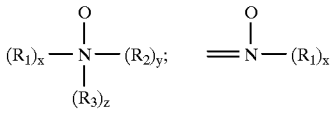

wherein $R_1$, $R_2$, $R_3$ are aliphatic, aromatic, heterocyclic or alicyclic groups or combinations thereof; x, y and z are 0 or 1; and the nitrogen of the N—O group can be attached or form part of any of the aforementioned groups. The amine oxide unit of the polyamine N-oxides has a pKa<10, preferably pKa<7, more preferred pKa<6.

Any polymer backbone can be used as long as the amine oxide polymer formed is water-soluble and has dye transfer inhibiting properties. Example of suitable polymeric backbones are polyvinyls, polyalkylenes, polyesters, polyethers, polyamide, polyimides, polyacrylates and mixtures thereof. These polymers include random or block copolymers where one monomer type is an amine N-oxide and the other monomer type is an N-oxide. The amine N-oxide polymers typically have a ratio of amine to the amine N-oxide of 10:1 to 1:1,000,000. However, the number of amine oxide groups present in the polyamine oxide polymer can be varied by appropriate copolymerization or by an appropriate degree of N-oxidation. The polyamine oxides can be obtained in almost any degree of polymerization. Typically, the average molecular weight is within the range of 500 to 1,000,000; more preferred 1,000 to 500,000; most preferred 5,000 to 100,000. This preferred class of materials can be referred to as "PVNO".

The most preferred polyamine N-oxide useful in the detergent compositions herein is poly(4-vinylpyridine-N-oxide) which as an average molecular weight of about 50,000 and an amine to amine N-oxide ratio of about 1:4.

Copolymers of N-vinylpyrrolidone and N-vinylimidazole polymers (referred to as a class as "PVPVI") are also preferred for use herein. Preferably the PVPVI has an average molecular weight range from 5,000 to 1,000,000, more preferably from 5,000 to 200,000, and most preferably from 10,000 to 20,000. (The average molecular weight range is determined by light scattering as described in Barth, et al., *Chemical Analysis,* Vol 113. "Modern Methods of Polymer Characterization", the disclosures of which are incorporated herein by reference.) The PVPVI copolymers typically have a molar ratio of N-vinylimidazole to N-vinylpyrrolidone from 1:1 to 0.2:1, more preferably from 0.8:1 to 0.3:1, most preferably from 0.6:1 to 0.4:1. These copolymers can be either linear or branched.

The present invention compositions also may employ a polyvinylpyrrolidone ("PVP") having an average molecular weight of from about 5,000 to about 400,000, preferably from about 5,000 to about 200,000, and more preferably from about 5,000 to about 50,000. PVP's are known to persons skilled in the detergent field; see, for example, EP-A-262,897 and EP-A-256,696, incorporated herein by reference. Compositions containing PVP can also contain polyethylene glycol ("PEG") having an average molecular weight from about 500 to about 100,000, preferably from about 1,000 to about 10,000. Preferably, the ratio of PEG to PVP on a ppm basis delivered in wash solutions is from about 2:1 to about 50:1, and more preferably from about 3:1 to about 10:1.

The detergent compositions herein may also optionally contain from 0.005% to 5% by weight of certain types of hydrophilic optical brighteners which also provide a dye transfer inhibition action. If used, the compositions herein will preferably comprise from 0.01% to 1% by weight of such optical brighteners.

The hydrophilic optical brighteners useful in the present invention are those having the structural formula:

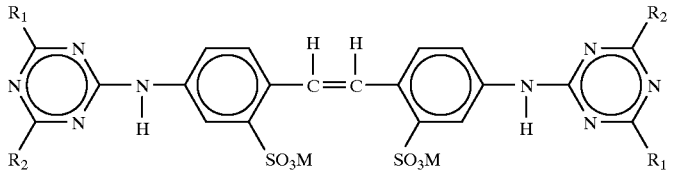

wherein $R_1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4',-bis[(4-anilino-6-(N-2-bis-hydroxyethyl)-s-triazine-2-yl)amino]-2,2'-stilbenedisulfonic acid and disodium salt. This particular brightener species is commercially marketed under the tradename Tinopal-UNPA-GX by Ciba-Geigy Corporation. Tinopal-UNPA-GX is the preferred hydrophilic optical brightener useful in the detergent compositions herein.

When in the above formula, $R_1$ is anilino, $R_2$ is N-2-hydroxyethyl-N-2-methylamino and m is a cation such as sodium, the brightener is 4,4'-bis[(4-anilino-6-(N-2-hydroxyethyl-N-methylamino)-s-triazine-2-yl)amino]2,2'-stilbenedisulfonic acid disodium salt. This particular brightener species is commercially marketed under the tradename Tinopal 5BM-BX by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species is commercially marketed under the tradename Tinopal AMS-GX by Ciba Geigy Corporation.

The specific optical brightener species selected for use in the present invention provide especially effective dye transfer inhibition performance benefits when used in combination with the selected polymeric dye transfer inhibiting agents hereinbefore described. The combination of such selected polymeric materials (e.g., PVNO and/or PVPVI) with such selected optical brighteners (e.g., Tinopal UNPA-GX, Tinopal 5BM-GX and/or Tinopal AMS-GX) provides significantly better dye transfer inhibition in aqueous wash solutions than does either of these two detergent composition components when used alone. Without being bound by theory, it is believed that such brighteners work this way because they have high affinity for fabrics in the wash solution and therefore deposit relatively quick on these fabrics. The extent to which brighteners deposit on fabrics in the wash solution can be defined by a parameter called the "exhaustion coefficient". the exhaustion coefficient is in general as the ratio of a) the brightener material deposited on fabric to b) the initial brightener concentration in the wash liquor. Brighteners with relatively high exhaustion coefficients are the most suitable for inhibiting dye transfer in the context of the present invention.

Of course, it will be appreciated that other, conventional optical brightener types of compounds can optionally be used in the present compositions to provide conventional fabric "brightness" benefits, rather than a true dye transfer inhibiting effect. Such usage is conventional and well-known to detergent formulations.

According to the present invention the detergent composition may comprise any other ingredients commonly employed in conventional detergent compositions such as soaps, suds suppressors, dye transfer inhibitors, perfumes, softeners, brighteners, enzymes and enzyme stabilisers.

Use of the Combination of Soil Release Agents and Polysaccharide Ethers

The compositions of the present invention may be used in laundry detergent compositions, fabric treatment compositions and fabric softening compositions in addition to hard surface cleaners. The compositions may be formulated as conventional granules, bars, pastes or powder or non aqueous liquid forms or as part of a dryer added sheet. The detergent compositions are manufactured in conventional manner, for example in the case of powdered detergent compositions, spray drying or spray mixing processes may be utilised.

The polysaccharide ether and soil release agent combination of the present invention are present at aqueous concentrations of from 1 ppm to 300 ppm, preferably from 5 ppm to 100 ppm in the wash solution, preferably at a pH of from 7 to 11, preferably from 9 to 10.5.

The present invention also relates to a method of laundering fabrics and concurrently providing a soil release finish thereto. The method comprises contacting said fabric with an aqueous laundry liquor containing conventional detersive ingredients described herein in addition to the soil release agent and polysaccharide ether of the present invention. In a preferred method polyester and polyester-cotton blends and other synthetic fabrics are used. The most preferred method for simultaneously cleaning and soil release treatment is a "multi-cycle" method, whereby the best results are obtained after two or more cycles comprising the steps of:

a) contacting said fabric with said aqueous laundry liquor in a conventional automatic washing machine or by hand washing for periods of from about 5 minutes to about 1 hour;
b) rinsing said fabrics with water;
c) line- or tumble drying said fabrics; and
d) exposing said fabrics to soiling through normal wear or domestics use.

EXAMPLES

Abbreviations used in Examples in the detergent compositions, the abbreviated component identifications have the following meanings:

XYAS: Sodium $C_{1X}$–$C_{1Y}$ alkyl sulphate
25EY: A $C_{12-15}$ predominantly linear primary alcohol condensed with an average of Y moles of ethylene oxide
XYEZ: A $C_{1x}$–$C_{1y}$ predominantly linear primary alcohol condensed with an average of Z moles of ethylene oxide
XYEZS: $C_{1X}$–$C_{1Y}$ sodium alkyl sulphate condensed with an average of Z moles of ethylene oxide per mole
TFAA: $C_{16}$–$C_{18}$ alkyl N-methyl glucamide.
Silicate: Amorphous Sodium Silicate ($SiO_2$:$Na_2O$ ratio=2.0)
NaSKS-6: Crystalline layered silicate of formula δ-$Na_2Si_2O_5$
Carbonate: Anhydrous sodium carbonate
MA/AA: Copolymer of 30:70 maleic/acrylic acid, average molecular weight about 70,000.
Zeolite A: Hydrated Sodium Aluminosilicate of formula $Na_{12}(AlO_2SiO_2)_{12}$. $27H_2O$ having a primary particle size in the range from 1 to 10 micrometers
Citrate: Tri-sodium citrate dihydrate
Percarbonate: Anhydrous sodium percarbonate bleach coated with a coating of sodium silicate ($Si_2O$:$Na_2O$ ratio=2:1) at a weight ratio of percarbonate to sodium silicate of 39:1
CMC: Sodium carboxymethyl cellulose
DETPMP: Diethylene triamine penta (Methylene phosphonic acid), marketed by Monsanto under the Tradename Dequest 2060
PVNO: Poly(4-vinylpyridine)-N-oxide copolymer of vinylimidazole and vinylpyrrolidone having an average molecular weight of 10,000.
Smectite Clay: Calcium montmorillonite ex. Colin Stewart Minchem Ltd.
SRA 1*: Soil release agent comprising a backbone of 4(oxyalkylene terephthalate units) and 1 (sulphoisoterephthalate unit) end capped with sulphonated glycol based end caps having an ethylene to propylene ratio of 1.7 and an average molecular weight of less than 3000.
SRA 2*: Soil release agent comprising a backbone of 11(oxyalkylene terephthalate units) and 2(sulphoisoterephthalate unit) end capped with sulphobenzoyl units and an average weight of less than 3000.
Granular Suds Suppressor: 12% Silicone/silica, 18% stearyl alcohol, 70% starch in granular form
LAS: Sodium linear $C_{12}$ alkyl benzene sulphonate
TAS: Sodium tallow alkyl sulphate
SS: Secondary soap surfactant of formula 2-butyl octanoic acid
Phosphate: Sodium tripolyphosphate
TAED: Tetraacetyl ethylene diamine
PVP: Polyvinyl pyrrolidone polymer
HMWPEO: High molecular weight polyethylene oxide
MC1: Methyl cellulose ether with dp=650 available from Shin Etsu Chemicals
MC2: Methyl cellulose ether (Methol 60 HG) obtained from Fluka, with a % mole of 28–30 dp
HPMC: Hydroxypropyl methylcellulose ether with dp=300–350
TAE 25: Tallow alcohol ethoxylate (25)

Example 1

The following laundry detergent compositions A, B, C, D and E were prepared. Compositions B and D represent the invention.

| | A | B | C | D | E |
|---|---|---|---|---|---|
| 45AS/25AS(3:1) | 9.1 | 9.1 | 9.1 | 9.1 | 9.1 |
| 35AE3S | 2.3 | 2.3 | 2.3 | 2.3 | 2.3 |
| 24E5 | 4.5 | 4.5 | 4.5 | 4.5 | 4.5 |
| TFAA | 2.0 | 2.0 | 2.0 | 2.0 | 2.0 |
| Zeolite A | 10.2 | 10.2 | 10.2 | 10.2 | 10.2 |
| SRA 1* | 0.2 | 0.2 | — | — | — |
| SRA 2* | — | — | 0.27 | 0.27 | — |
| MC2 | — | 1 | — | 1 | 1 |
| Na SKS-6/citric acid (79:21) | 10.6 | 10.6 | 10.6 | 10.6 | 10.6 |
| Carbonate | 7.6 | 7.6 | 7.6 | 7.6 | 7.6 |
| TAED | 5 | 6.67 | 6.67 | 6.67 | 6.67 |
| Percarbonate | 22.5 | 22.5 | 22.5 | 22.5 | 22.5 |
| DETPMP | 0.5 | 0.5 | 0.5 | 0.5 | 0.5 |
| Protease | 0.55 | 0.55 | 0.55 | 0.55 | 0.55 |
| Polcarboxylate | 3.1 | 3.1 | 3.1 | 3.1 | 3.1 |
| CMC | 0.4 | 0.4 | 0.4 | 0.4 | 0.4 |
| PVNO | 0.03 | 0.03 | 0.03 | 0.03 | 0.03 |
| Granular suds suppressor | 1.5 | 1.5 | 1.5 | 1.5 | 1.5 |
| Minors/misc to 100% | | | | | |

Clay soil removal performance of composition D was compared to the performance of reference compositions (C and E). The soil removal testing was carried out using a standard UK Hotpoint washing machine using city water at 12° H hardness (German hardness) at 40° C. The polyester and polycotton unstained fabrics were prewashed for two cycles (long cycle setting) using a 1 kg. balast of housewife soiled cotton load with 100 g of one of the product compositions, delivered via the dispensing drawer of the Hotpoint machine. 10 g. of clay sampled from the Newcastle area, UK, was added to 10 ml of distilled water to form a slurry, which was brushed homogeneously onto the fabric samples. The fabric samples were dried overnight at ambient temperatures and subsequently washed under the same conditions described herein above. The test was repeated four times for each soil test.

The difference in soil removal performance using the well known Scheffe scale was recorded in panel score units (psu), positive values indicating a better performance than the reference products. The following grading was used:

psu 0=equal
1=I think this one is better
2=I know this one is better
3=This one is a lot better
4=This one is a whole lot better The grade was carried out under controlled standard northern european lighting by four trained graders. The average score is given below.

| Composition | C | E | D | LSD |
|---|---|---|---|---|
| PSU | | | | |
| Polyester 0.7 | Ref | −1.8 s | +0.8 s | |
| Polycotton (65/35 polyester/cotton) | Ref | −1.9 s | +1.5 s | 1. |

The 's' PSU values denotes that the score was significant on a 95% confidence limit. The results clearly show the synergistic effect of the combination of the invention.

Example 2

Granular fabric cleaning compositions in accord with the invention are prepared as follows:

| | I | II |
|---|---|---|
| SRA 1* | 0.14 | 0.14 |
| SRA 2* | — | — |
| MC1 | 0.75 | — |
| HPMC | — | 0.5 |
| LAS | 22.0 | 22.0 |
| Phosphate | 23.0 | 23.0 |
| Carbonate | 23.0 | 23.0 |
| Silicate | 14.0 | 14.0 |
| Zeolite A | 8.2 | 8.2 |
| DETPMP | 0.4 | 0.4 |
| Sodium Sulfate | 5.5 | 5.5 |
| Water/minors | Up to 100% | |

Example 3

Granular fabric cleaning compositions in accord with the invention are prepared as follows:

| | I | II |
|---|---|---|
| LAS | 12.0 | 12.0 |
| Zeolite A | 26.0 | 26.0 |
| SS | 4.0 | 4.0 |
| 24AS | 5.0 | 5.0 |
| Citrate | 5.0 | 5.0 |
| Sodium Sulfate | 17.0 | 17.0 |
| Perborate | 16.0 | 16.0 |
| TAED | 5.0 | 5.0 |
| HPMC | — | 0.5 |
| MC1 | 0.75 | — |
| SRA 1* | 0.14 | 0.14 |
| Water/minors | | Up to 100% |

Example 4

Granular fabric cleaning compositions in accord with the invention which are especially useful in the laundering of coloured fabrics are prepared as follows:

| | | | | | | |
|---|---|---|---|---|---|---|
| LAS | 11.4 | 10.7 | 11.4 | 10.7 | — | — |
| TAS | 1.8 | 2.4 | 1.8 | 2.4 | — | — |
| TFAA | — | — | — | — | 4.0 | 4.0 |
| 45AS | 3.0 | 3.1 | 3.0 | 3.1 | 10.0 | 10.0 |
| 45E7 | 4.0 | 4.0 | 4.0 | 4.0 | — | — |
| 25E3S | — | — | — | — | 3.0 | 3.0 |
| 68E11 | 1.8 | 1.8 | 1.8 | 1.8 | — | — |
| 25E5 | — | — | — | — | 8.0 | 8.0 |
| Citrate | 14.0 | 15.0 | 14.0 | 15.0 | 7.0 | 7.0 |
| Carbonate | — | — | — | — | 10 | 10 |
| Citric acid | 3.0 | 2.5 | 3.0 | 2.5 | 3.0 | 3.0 |
| Zeolite A | 32.5 | 32.1 | 32.5. | 32.1 | 25.0 | 25.0 |
| Na-SKS-6 | — | — | — | — | 9.0 | 9.0 |
| MA/AA | 5.0 | 5.0 | 5.0 | 5.0 | 5.0 | 5.0 |
| DETPMP | 1.0 | 0.2 | 1.0 | 0.2 | 0.8 | 0.8 |
| HPMC | — | — | 0.5 | — | 0.5 | — |
| MC1 | 0.75 | 0.75 | — | 0.75 | — | 0.75 |
| SRA 1* | 0.14 | 0.14 | 0.14 | 0.14 | 0.14 | 0.14 |
| Silicate | 2.0 | 2.5 | 2.0 | 2.5 | — | — |
| Sulphate | 3.5 | 5.2 | 3.5 | 5.2 | 3.0 | 3.0 |
| PVP | 0.3 | 0.5 | 0.3 | 0.5 | — | — |
| Poly(4-vinyl pyridine-N-oxide/copolymer of vinyl-imidazole & vinyl-pyrrolidone | — | — | — | — | 0.2 | 0.2 |
| Perborate | 0.5 | 1.0 | 0.5 | 1.0 | — | — |
| Phenol sulfonate | 0.1 | 0.2 | 0.1 | 0.2 | — | — |
| Water/Minors | Up to 100% | | | | | |

Example 5

Granular fabric cleaning compositions in accord with the invention are prepared as follows:

| | | |
|---|---|---|
| LAS | 6.5 | 8.0 |
| Sulfate | 15.0 | 18.0 |
| Zeolite A | 26.0 | 22.0 |
| Sodium nitrilotriacetate | 5.0 | 5.0 |
| PVP | 0.5 | 0.7 |
| TAED | 3.0 | 3.0 |
| Boric acid | 4.0 | — |
| Perborate | 0.5 | 1.0 |
| Phenol sulphonate | 0.1 | — |
| HPMC | 0.5 | — |
| MC1 | — | 0.75 |
| SRA 1* | 0.14 | 0.14 |
| Silicate | 5.0 | 5.0 |
| Carbonate | 15.0 | 15.0 |
| Water/minors | Up to 100% | |

Example 6

A granular fabric cleaning compositions in accord with the invention which provide "softening through the wash" capability are prepared as follows:

| | | | | |
|---|---|---|---|---|
| 45AS | — | — | 10.0 | 10.0 |
| LAS | 7.6 | 7.6 | — | — |
| 68AS | 1.3 | 1.3 | — | — |
| 45E7 | 4.0 | 4.0 | — | — |
| 25E3 | — | — | 5.0 | 5.0 |
| Coco-alkyl-dimethyl hydroxy-ethyl ammonium chloride | 1.4 | 1.4 | 1.0 | 1.0 |
| Citrate | 5.0 | 5.0 | 3.0 | 3.0 |
| Na-SKS-6 | — | — | 11.0 | 11.0 |
| Zeolite A | 15.0 | 15.0 | 15.0 | 15.0 |
| MA/AA | 4.0 | 4.0 | 4.0 | 4.0 |
| DETPMP | 0.4 | 0.4 | 0.4 | 0.4 |
| Perborate | 15.0 | 15.0 | — | — |
| Percarbonate | — | — | 15.0 | 15.0 |
| TAED | 5.0 | 5.0 | 5.0 | 5.0 |
| Smectite clay | 10.0 | 10.0 | 10.0 | 10.0 |
| HMWPEO | — | — | 0.1 | 0.1 |
| HPMC | — | 0.5 | — | 0.5 |
| MC1 | 0.75 | — | 0.75 | — |
| SRA 1* | 0.14 | 0.14 | 0.14 | 0.14 |
| Silicate | 3.0 | 3.0 | 5.0 | 5.0 |

-continued

| | | | | |
|---|---|---|---|---|
| Carbonate | 10.0 | 10.0 | 10.0 | 10.0 |
| Granular suds suppressor | 1.0 | 1.0 | 4.0 | 4.0 |
| CMC | 0.2 | 0.2 | 0.1 | 0.1 |
| Water/minors | | | Up to 100% | |

We claim:

1. A detergent composition comprising, by weight, from 0.01% to 10% of a nonionic polysaccharide ether having a degree of polymerisation of at least 100, and from 0.01% to 5% of a soil release agent comprising at least one oxyalkylene unit and at least one terephthalate or substituted terephthalate unit and having a molecular weight of less than 10,000, wherein the weight ratio of the polysaccharide ether to the soil release agent is from 0.1:1 to 20:1.

2. A detergent composition according to claim 1, wherein said soil release agent further comprises a polyester backbone comprising at least one dimethylterephthalate unit and at least one dimethylsulphoisophthalate unit.

3. A detergent composition according to claim 2, wherein at least 50% by weight of said soil release agent comprises at least one terminal capping unit selected from the group consisting of anionic, nonionic, cationic capping units and mixtures thereof.

4. A detergent composition according to claim 3, wherein said terminal capping unit is an anoinic capping unit.

5. A detergent composition according to claim 4, wherein said terminal capping unit is according to the formula $(MO_3S)(CH_2)_m(CH_2CH_2O)(RO)_n$, wherein M is a salt forming cation, m is 0 or 1, R is ethylene, propylene or a mixture thereof and n is from 0 to 2.

6. A detergent composition according to claim 4, wherein said terminal capping unit is derived from sulphobenzoic acid or derivatives thereof.

7. A detergent composition according to claim 3, wherein said terminal capping unit is a nonionic capping unit comprising from 2 to 20consecutive polyethylene glycol units.

8. A detergent composition according to claim 3, wherein said cationic terminal capping unit is a cationic unit according to the formula $R_4N^+$, wherein each R is independently selected from the group consisting of $C_1$–$C_4$ alkyl groups, $C_1$–$C_4$ hydroxyalkyl groups, $C_2$–$C_4$ alkylene groups, $C_2$–$C_4$ oxyalkylene groups, phenyl, phenyl $C_1$–$C_4$ alkyl groups, and hydrogen, and wherein two R groups can be joined to form cyclic structures.

9. A detergent composition according to claim 1, wherein said nonionic polysaccharide ether is selected from the group consisting of cellulose ethers, starch ethers, dextran ethers and mixtures thereof.

10. A detergent composition according to claim 9, wherein said cellulose ether is a $C_1$–$C_4$ alkyl cellulose ether, a $C_1$–$C_4$ hydroxyalkyl cellulose ether, a $C_1$–$C_4$ alkylhydroxy alkyl cellulose ether or mixtures thereof.

11. A detergent composition according to claim 9, wherein said polysaccharide ether is a methylcellulose ether.

12. A detergent composition according to claim 1 wherein said polysaccharide ether has a degree of polymerisation of from 100 to 10000 and a degree of substitution of from 0.5 to 2.5 inclusive.

13. A detergent composition according to claim 11, wherein said soil release agent has a molecular weight of less than 5000.

14. A detergent composition according to claim 1, further comprising a detergent adjunct selected from the group consisting of surfactants, chelants, builders and mixtures thereof.

15. A detergent composition according to claim 1, comprising, by weight, from 0.01% to 3% of the nonionic polysaccharide ether, and from 0.01% to 3% of the soil release agent.

16. A method of treating fabrics and providing a soil release finish thereto, comprising contacting said fabrics with an aqueous liquor containing from 1 ppm to 300 ppm of the combination of said nonionic polysaccharide and said soil release agent according to claim 1.

17. A detergent composition comprising, by weight, from 0.01% to 10% of a nonionic polysaccharide ether having a degree of polymerisation of at least 100, and from 0.01% to 5% of a soil release agent comprising oxyalkylene terephthalate unit and at least one sulphoisoterephthalate unit and having a molecular weight of less than 10,000, wherein the weight ratio of the polysaccharide ether to the soil release agent is from 0.1:1 to 20:1.

18. A detergent composition according to claim 17, wherein the soil release agent has a molecular weight of from about 500 to about 5,000.

19. A detergent composition according to claim 17, wherein the soil release agent comprises sulphonated end-capping units.

20. A detergent composition according to calim 17, comprising, by weight from 0.01% to 3% of the nonionic polysaccharide ether, and from 0.01% to 3% of the soil release agent.

* * * * *